US007631792B2

(12) United States Patent
Christy

(10) Patent No.: US 7,631,792 B2
(45) Date of Patent: Dec. 15, 2009

(54) BACKPACK

(76) Inventor: Philip Troy Christy, 52 Martin Rd., Hopewell Junction, NY (US) 12533

( * ) Notice: Subject to any disclaimer, the term of this patent is extended or adjusted under 35 U.S.C. 154(b) by 1029 days.

(21) Appl. No.: 11/101,044

(22) Filed: Apr. 7, 2005

(65) Prior Publication Data

US 2006/0226192 A1 Oct. 12, 2006

(51) Int. Cl.
*A45F 3/04* (2006.01)

(52) U.S. Cl. ..... 224/644; 224/642

(58) Field of Classification Search ..... 383/642, 383/644

See application file for complete search history.

(56) References Cited

U.S. PATENT DOCUMENTS

| | | | | |
|---|---|---|---|---|
| 3,071,133 | A | 1/1963 | Eisen | |
| 3,679,108 | A * | 7/1972 | Ingram | 224/644 |
| 4,178,923 | A | 12/1979 | Curlee | |
| 4,384,602 | A | 5/1983 | Ores | |
| 5,228,609 | A | 7/1993 | Gregory | |
| 5,547,461 | A * | 8/1996 | Levis | 602/19 |
| 5,940,880 | A * | 8/1999 | Phillips | 2/7 |
| 6,179,186 | B1 | 1/2001 | Blanking | |
| 6,345,744 | B1 * | 2/2002 | Eldridge | 224/153 |
| 6,471,105 | B1 | 10/2002 | Ammerman | |
| 6,722,543 | B1 | 4/2004 | Fitzgerald | |
| 6,793,112 | B2 * | 9/2004 | Ammerman | 224/607 |
| 6,820,783 | B2 | 11/2004 | Beale | |
| 6,824,030 | B1 | 11/2004 | Dolan | |
| 2002/0158097 | A1 * | 10/2002 | Beale | 224/644 |
| 2002/0189003 | A1 | 12/2002 | Babcock | |

FOREIGN PATENT DOCUMENTS

| | | |
|---|---|---|
| WO | WO 02/47510 | 6/2002 |

* cited by examiner

*Primary Examiner*—Nathan J Newhouse
*Assistant Examiner*—Jack H Morgan, Jr.
(74) *Attorney, Agent, or Firm*—Joseph L. Spiegel; Heslin Rothenberg Farley & Mesiti PC

(57) ABSTRACT

A backpack is provided with a cushioning, inflatable bladder, the lower part of which extends across the bottom and an upwardly extending part so as when inflated, it generally conforms to the shape of the curvature of the thoracic region of the spine. The bladder is enclosed within a zippered bag wrapped around it that is joined to the outer surface of the backpack. A pump is provided for inflating the bladder. The pump is hand operated with a bulb-shaped configuration and connected to the bladder by means of a tube. An air valve connected to the tube controls the amount of air flow into the bladder and maintains the bladder in inflated position after air has been pumped in, and also permits deflation of the bladder. The pump and valve may be stored in a side pocket of the backpack provided for that purpose. Optionally, the pump could be battery operated.

3 Claims, 3 Drawing Sheets

BACKPACK

BACKGROUND OF THE INVENTION

1. Field of the Invention

This invention relates to backpacks of the type used by, for example, students to carry books, hikers to carry gear and the like. The backpack normally contains a pack and one or more pockets for storing items. The backpack is then strapped to the back of a user and carried in that fashion. The backpack described herein is of the type that uses an inflatable bladder and positioned beneath the pack and between the forward panel of the backpack and the user's back and for the purpose of relieving stress, weight and pressure on the back.

2. Description of the Prior Art

It is known that the abutting relation of the forward panel of the backpack against the back and spinal column can cause pain, fatigue and perhaps degeneration to affected areas of the back and spine. It is also known that most backpacks in use today place the majority of the weight of the backpack and its contents on the shoulders and on the middle and lower part of the back of the user.

In a number of cases, inflatable bladders have been utilized to provide support and/or avoid contact with particular areas of the back and spinal column.

Notwithstanding, there is still a need for a backpack employing an inflatable bladder for better distribution of the weight away from the user's back.

SUMMARY

An object of the invention is a backpack that when worn minimizes stress, weight and pressure on the back.

These and other objects, features and advantages are accomplished in accordance with the teachings of the present invention, one illustrative embodiment of which comprises a backpack provided with a cushioning, inflatable bladder, the lower part of which extends across the bottom and an upwardly extending part so as when inflated, it generally conforms to the shape of the curvature of the thoracic region of the spine. The bladder is enclosed within a zippered bag wrapped around it that is joined to the outer surface of the backpack. A pump is provided for inflating the bladder. The pump is hand operated with a bulb-shaped configuration and connected to the bladder by means of a tube. An air valve connected to the tube controls the amount of air flow into the bladder and maintains the bladder in inflated position after air has been pumped in, and also permits deflation of the bladder. The pump and valve may be stored in a side pocket of the backpack provided for that purpose. Optionally, the pump could be battery operated.

BRIEF DESCRIPTION OF THE DRAWING

Other objects, features and advantages of the present invention will be apparent from the following detailed description and accompany drawing, wherein.

DETAILED DESCRIPTION

Figure 1:
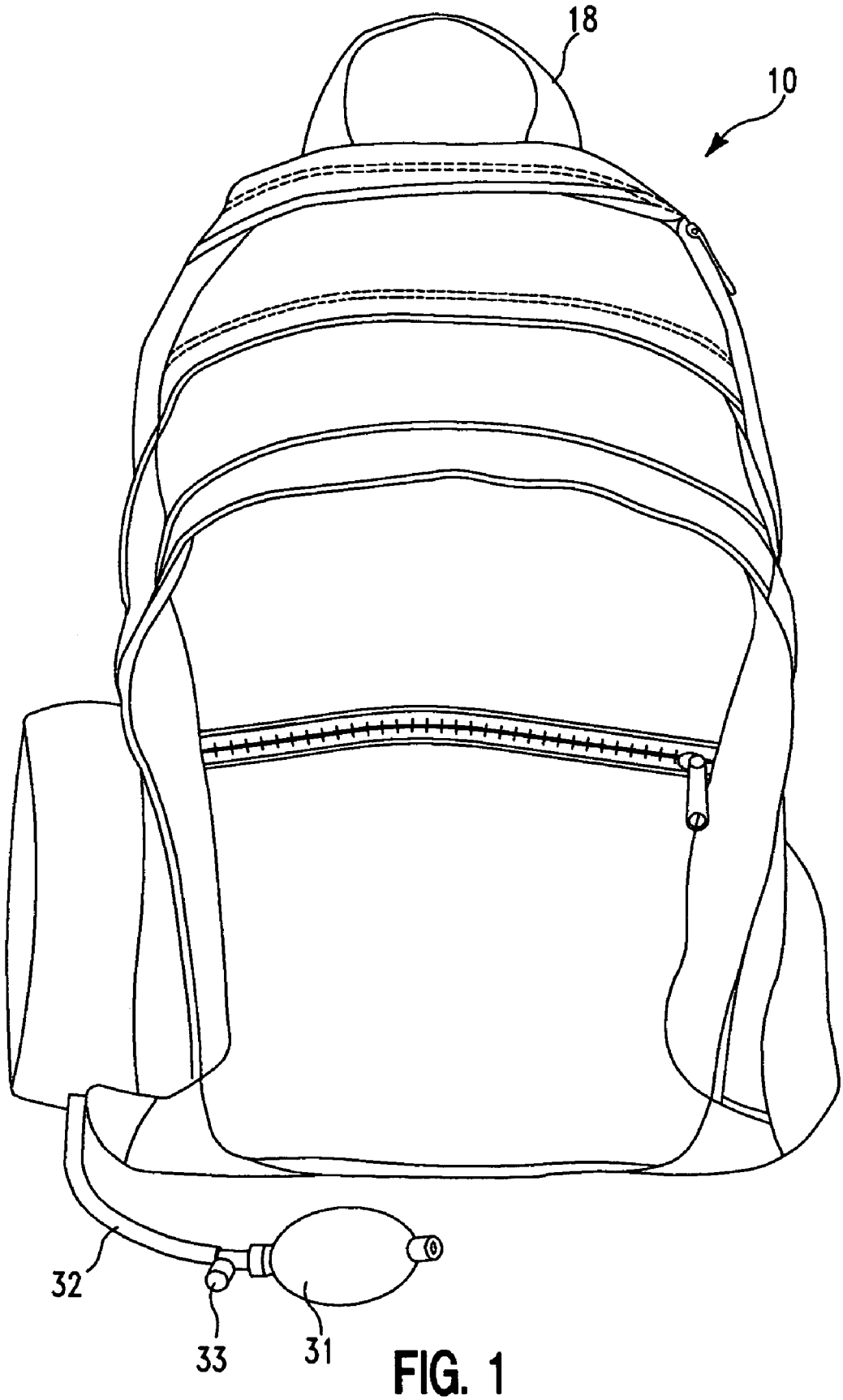
FIG. 1 is a perspective view of the backpack of the present invention.
Figure 2:
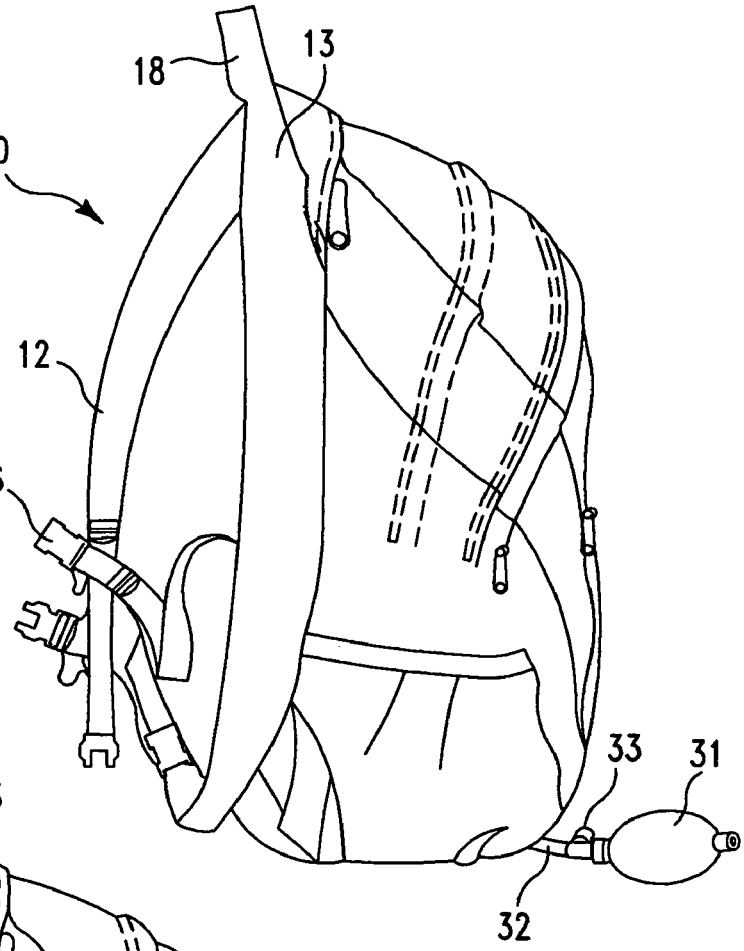
FIG. 2 is a side view of the backpack of the present invention with the backpack's bladder deflated.
Figure 3:
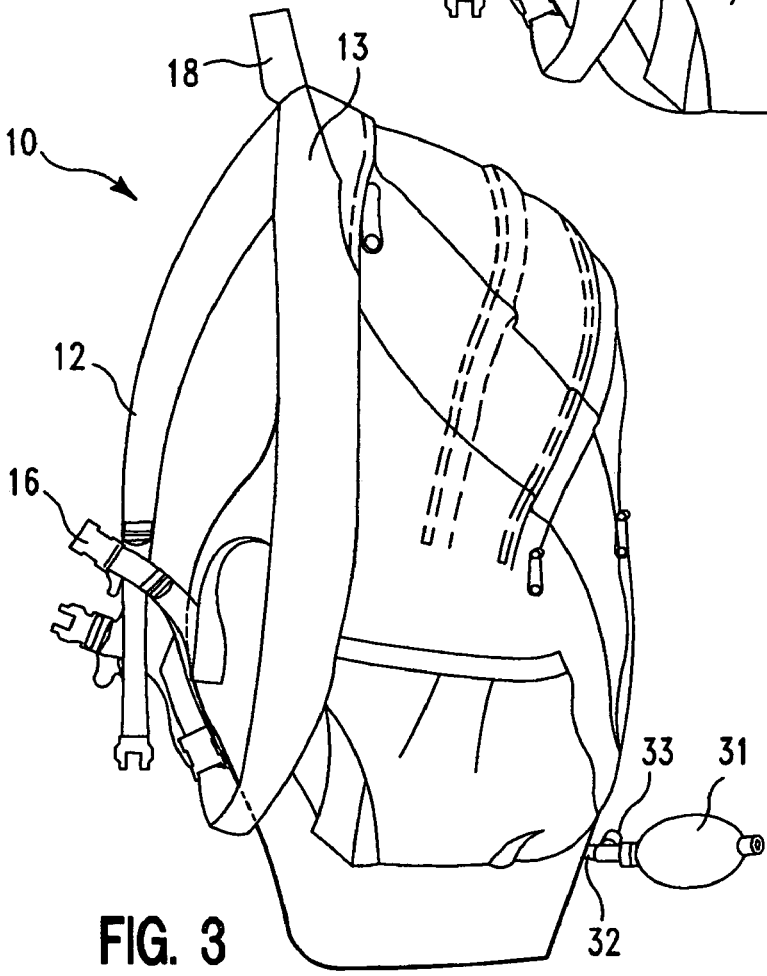
FIG. 3 is a side view of the backpack of the present invention with the backpack's bladder inflated.
Figure 4:
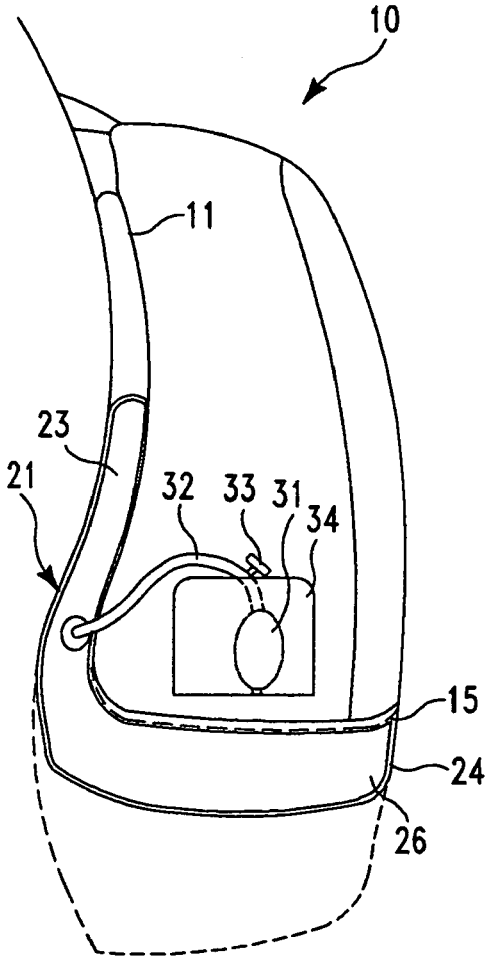
FIG. 4 is a view of the opposite side of the backpack when resting against a user's back, partially cut away; and, FIG. 5 is a schematic side sectional view of the backpack, partially cut away showing the positioning of the backpack relative to the user's back and spinal column.

Referring now to FIGS. 1 through 4 of the drawing, a backpack 10 is shown having a forward panel 11 that faces a user's back when worn, adjustable straps 12, 13 extending from the top of the backpack to the sides near the bottom of the pack for carrying the pack over the user's shoulders. A solid sheet 14, as of plastic or a composite, is sewn into and across and forms, with the lower part of the backpack material, the bottom 15 of the backpack. Optionally, an adjustable waist belt 16 for securement about the user's waist is provided. The straps 12, 13 are made thick, ¾ inches thick×3 inches wide to provide added cushioning.

Normally, the forward panel 11 forms one wall of a rearward-facing pack for carrying various articles. Typically, the backpack 10 will have a number of other pockets for receipt and carrying of items as well.

In a typical embodiment the backpack 10 is 20 inches high, 14 inches deep and 12 inches wide. However, the backpack 10 is to be made with differing dimensions, depending upon the size of the user. The backpack is made of canvas, typically, except for the solid sheet 14 of the bottom.

The backpack 10 is also provided with a strap 18 at its top for hanging the backpack when not being carried by a user.

In accordance with the teachings of the present invention, the backpack is provided with a cushioning, inflatable bladder 21, the lower part 22 of which extends across the bottom 15 beneath the pack, and an upwardly extending part 23 positioned entirely across the forward panel 11 and from near the bottom, typically four inches from the bottom of the panel 11, extending upwardly, typically 8 to 10 inches, so as when inflated, it generally conforms to the shape of the curvature of the thoracic region of the spine. The bladder 21 is of flexible material such as rubber, elastomeric or polymeric material.

The bladder 21 is enclosed within a zippered bag 24 wrapped around it that is joined to the outer surface of the backpack.

A pump 31 is provided for inflating the bladder 21. The pump 31 is hand operated with a bulb-shaped configuration. The pump 31 is connected to the bladder 21 by means of a tube 32. An air valve 33 connected to the tube 32 controls the amount of air flow into the bladder 21 and maintains the bladder 21 in inflated position after air has been pumped in, and also permits deflation of the bladder 21. The pump 31 and valve 33 may be stored in a side pocket 34 of the backpack 10 provided for that purpose. Optionally, the pump could be battery operated.

In use, the user straps the backpack 10 on his shoulders so it rests comfortably on same. The bladder 21 is then inflated, the amount of inflation being dependent on the individual's comfort level. The bladder 21 can expand up to four inches in width.

In partially inflated position (FIGS. 3 and 4), the bladder begins to expand as it is filled with air. In fully expanded condition (dotted area in FIG. 4), the lower part 22 of the bladder 21 will rest upon the user's buttocks. In fully inflated position, the upper part 23 of the bladder 21 conforms to the curvature of the thoracic region of the user's body and rests comfortably against the back. The solid sheet 14 at the bottom of the backpack prevents the expansion of the bladder 21 from taking up space in the pack. In this way it is assured that the lower part 22 of the bladder will expand under the pack and not into it. The feeling to the user is that a significant portion of the weight of the backpack and contents is removed. After or along with inflation, the shoulder straps may be adjusted so that the backpack finds itself in the desired position.

Figure 5:
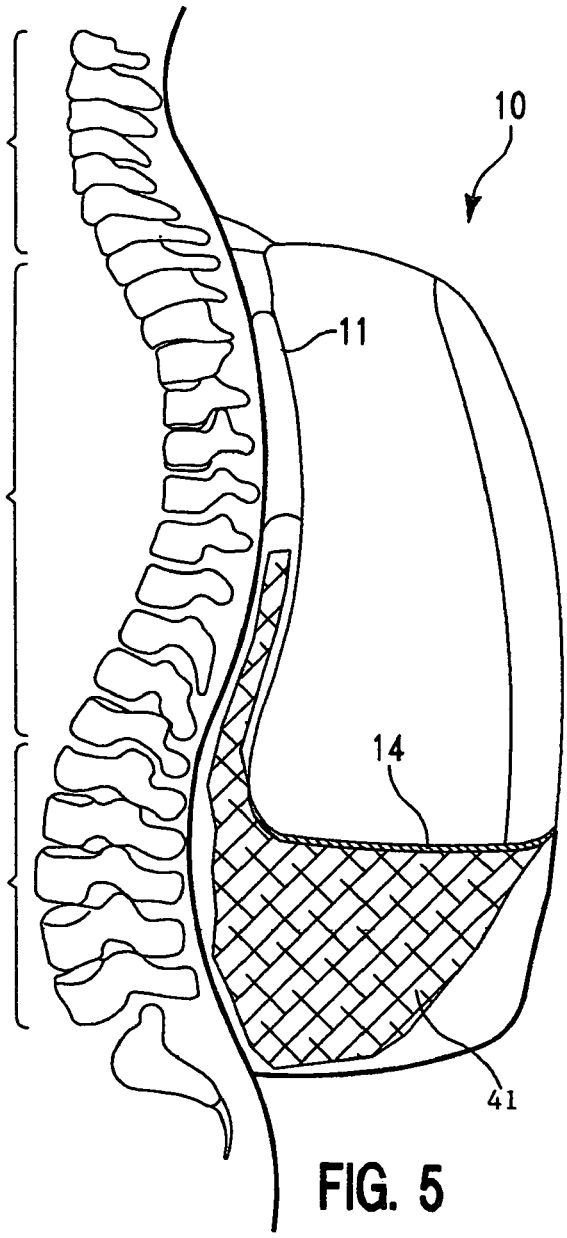

Instead of an air bladder, and with reference to FIG. 5, foam padding 41 can be used to fill the bag 41, but with less desirable results. With an air bladder, there can be adjustment of the inflation level of the bladder to different levels for different uses.

The back is relieved from stress, weight and pressure. The inflation of the air bladder moves the pack away from the back, shifting some of the weight to now be borne by the shoulders and with part of the weight now being supported by the buttocks area.

The backpack can be made in different styles and sizes, for example, a student pack, one for hiking and one for military use.

It should be obvious that changes, additions and omissions may be made in the details and arrangement of parts without departing from the spirit and scope of the invention as hereinafter claimed.

What is claimed is:

1. A backpack for relieving stress, weight and pressure from a user's back, comprising:

a pack for storing items, having top, forward panel to face the user's back, sides, bottom, and, outer surface;

adjustable shoulder straps extending from the top to the bottom of the pack, for enabling the positioning the pack on the user's back and, for carrying the pack over the user's shoulders;

a bag joined to the backpack outer surface having a lower portion beneath the pack bottom, and a forward portion part-way up the forward panel;

a cushioning, inflatable bladder enclosed within the bag, having a lower part extending across and beneath the bottom of the pack, and, an upper part extending part-way upwardly along the forward panel;

the bag and bladder being so constructed and arranged that upon inflation of the bladder, the bladder expands to a generally L-shaped configuration, with the bag lower portion and the bladder lower part expanding beneath the pack and resting upon and generally conforming to the buttocks area of the user, and, upon inflation, with the bag forward panel portion and bladder upper part expanding and continuing from the bag lower portion and the bladder lower part, respectively, extending at an angle part-way up the forward panel, so as to rest part-way up against the user's back and generally conforming to the curvature of the thoracic region of the user's body; and, wherein the backpack bottom includes a solid sheet for preventing expansion into the pack upon bladder inflation.

2. The backpack of claim 1 including a pump for inflating the bladder and valve means for controlling the flow of air to and from the bladder.

3. The backpack of claim 2 wherein the backpack is provided with a side pocket for storage of the pump and valve.

* * * * *